US006729407B2

(12) United States Patent
Stoesz

(10) Patent No.: US 6,729,407 B2
(45) Date of Patent: May 4, 2004

(54) METHOD FOR REMOVING GRAVEL PACK SCREENS

(75) Inventor: Carl W. Stoesz, Pasadena, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/238,524

(22) Filed: Sep. 10, 2002

(65) Prior Publication Data

US 2004/0045715 A1 Mar. 11, 2004

(51) Int. Cl.[7] ..... E21B 31/20

(52) U.S. Cl. ..... 166/301; 166/177.6; 166/98; 166/72; 166/278; 175/56; 294/86.12; 366/119

(58) Field of Search ..... 166/301, 177.6, 166/98, 72, 158, 278, 311, 312; 175/56; 366/119, 124; 294/86.12

(56) References Cited

U.S. PATENT DOCUMENTS

| | | | | |
|---|---|---|---|---|
| 2,247,188 A | | 6/1941 | Davis | |
| 4,227,576 A | * | 10/1980 | Calderon | 166/312 |
| 4,236,580 A | | 12/1980 | Bodine | |
| 4,260,016 A | * | 4/1981 | Calderon | 166/74 |
| 4,299,279 A | | 11/1981 | Bodine | |
| 4,667,742 A | | 5/1987 | Bodine | |
| 4,913,234 A | | 4/1990 | Bodine | |
| 5,234,056 A | | 8/1993 | Bodine | |
| 5,295,538 A | * | 3/1994 | Restarick | 166/205 |
| 5,309,405 A | | 5/1994 | Brett et al. | |
| 5,377,750 A | * | 1/1995 | Arterbury et al. | 166/205 |
| 5,413,176 A | | 5/1995 | Restarick | |
| 5,762,137 A | | 6/1998 | Ross et al. | |
| 5,803,182 A | | 9/1998 | Bakke | |
| 5,909,773 A | * | 6/1999 | Koehler et al. | 166/277 |
| 5,913,365 A | | 6/1999 | Bryant | |
| 6,009,948 A | | 1/2000 | Flanders et al. | |
| 6,182,775 B1 | | 2/2001 | Hipp | |

* cited by examiner

*Primary Examiner*—Roger Schoeppel
(74) *Attorney, Agent, or Firm*—Steve Rosenblatt

(57) ABSTRACT

A method of removing a gravel packed screen to reach another zone is described. The method involves a bottom hole assembly comprising an isolation device for the screen and a tool to latch on to it. A perforating gun is shot off to put holes in the screen to allow gravel to come through. A flow through a reversing valve is initiated to urge the gravel into the newly perforated screen while a vibrator shakes the screen and stimulates gravel flow through the screen. Alternatively, the screen is not isolated and a reverse circulation from the surface in conjunction with vibration urges the gravel to flow through the screen and out through the tubing supporting the bottom hole assembly.

20 Claims, 1 Drawing Sheet

METHOD FOR REMOVING GRAVEL PACK SCREENS

FIELD OF THE INVENTION

The field of this invention relates to methods for removal of screen after a gravel packing operation so that production from another or lower interval can commence.

BACKGROUND OF THE INVENTION

Occasionally well strings get stuck during drilling or completion activities creating a need to work them loose. Vibratory devices have been used to loosen stuck tubulars downhole. Several examples of such devices are U.S. Pat. Nos. 4,299,279; 5,803,182; 6,182,775; 6,009,948; 5,234,056; 4,667,742; 4,913,234 and 4,236,580. Vibratory devices have been used in conjunction with gravel packing operation to help disperse the sand around the outside of the screen and into the previously perforated casing. This technique is shown in FIG. 53 of U.S. Pat. No. 5,309,405. In situations where further production is desired from a zone beyond a gravel packed screen, it was in the past necessary to either mill out the screen or to start a lateral above it and otherwise isolate that branch of the well. Other techniques involved trying to wash over the screen and lift it out. The problem with the latter technique is that the gravel outside the screen would firmly wedge it in place so that the screen would not break loose within the pulling limits of the string or the surface equipment. Milling the screen created a debris removal issue and drilling a sidetrack was a lengthy process involving sophisticated equipment and was very costly.

The methods of the present invention address the shortcomings of the prior techniques to provide a technique that will simply get the screen out. The wedged screen is perforated to allow gravel to flow into its interior. A combination of vibration and circulation or reverse circulation is utilized after the screen is isolated in the well to get the gravel to flow and the screen to let go. The screen, being retained by the bottom hole assembly can be subsequently retrieved with minimal damage to the well. Further completion work can go on beyond the former screen location. These methods will be more readily understood by those skilled in the art from a review of the description of the preferred embodiment and the claims, which appear below.

SUMMARY OF THE INVENTION

A method of removing a gravel packed screen to reach another zone is described. The method involves a bottom hole assembly comprising an isolation device for the screen and a tool to latch on to it. A perforating gun is shot off to put holes in the screen to allow gravel to come through. A flow through a reversing valve is initiated to urge the gravel into the newly perforated screen while a vibrator shakes the screen and stimulates gravel flow through the screen. Alternatively, the screen is not isolated and a reverse circulation from the surface in conjunction with vibration urges the gravel to flow through the screen and out through the tubing supporting the bottom hole assembly.

DETAILED DESCRIPTION OF THE DRAWINGS

FIG. 1 is a schematic of the bottom hole assembly during run in;

DETAILED DESCRIPTION OF THE PREFERRED EMBODIMENT

Figure 1:
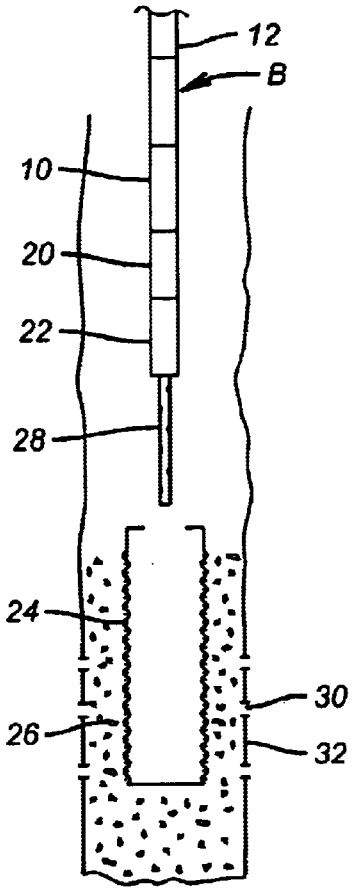
Figure 3:
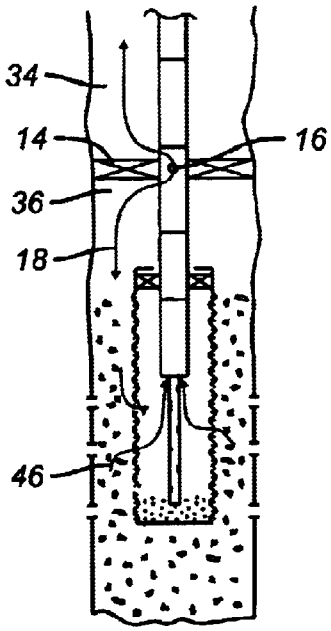
FIG. 3 is the view of FIG. 2 with circulation ongoing through the reversing valve.

FIG. 1 illustrates the bottom hole assembly as comprising a combination pack off tool and reversing valve 10 of a type known in the art to allow isolation as well as flow to enter through the tubing 12 and exit below the isolation seal 14 (see FIG. 3) through a port 16 as depicted by arrow 18. Below that tool is a vibration tool 20 and below that is a spear or other gripping device 22 to grab hold of screen 24 that has gravel 26 disposed tightly around it from a previous gravel packing operation. At the bottom of the bottom hole assembly is one or more known perforating guns or other tools that can make holes 28. Holes can be made with high velocity fluid streams or chemically by pumping a fluid that will attack or alter the screen 24 sufficiently to cause holes to form. The screen 24 is disposed adjacent perforations 30 previously made in casing 32 before the gravel packing operation was used to surround the screen 24 with gravel 26.

Figure 2:
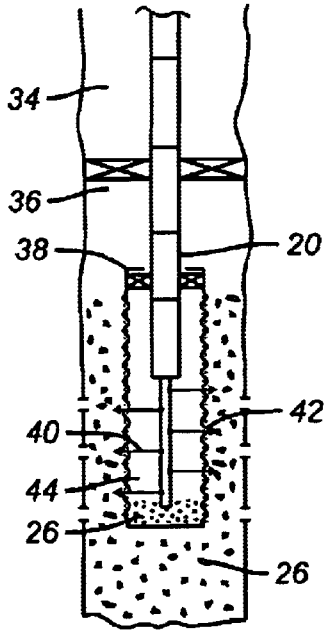
FIG. 2 is the view of FIG. 1 showing the screen gripped by the bottom hole assembly and isolated with the perforating gun going off.

The bottom hole assembly B is lowered, as shown in FIG. 2, until the spear 22 grabs the screen 24. The isolation seal 14 on the pack off tool 10 is activated creating two distinct zones 34 and 36 above and below isolation seal 14, respectively. At this time the perforating gun or guns 28 are inside the screen 24 and the vibration tool 20 is close to the top end 38 of the screen 24. Arrows 40 reflect the guns 28 being shot off making a plurality of holes 42 in the screen. This gives the gravel 26 a way of getting into the interior 44 of the screen 24.

Flow is initiated from the surface through tubing 12. Flow goes beyond isolation seal 14 and out ports 16, as indicated by arrow 18. The flow enters zone 36 through ports 16. At the same time, the vibration tool 20 is started. The vibration tool 20 can be powered electrically, by fluid flow, or by other known means. The return flow, represented by arrow 46 goes through the gravel 26 urging it into holes 42 and into the interior 44 of screen 24. The return flow 46 goes back through the pack off tool 10 and out to the surface through zone 34 outside of tubing 12 laden with the gravel. The vibration from vibration tool 20 works in conjunction with the return flow 46 to drive the gravel 26 through holes 42. The vibration shakes the screen 24 and the adjacent gravel 26. Flow 18 propels the gravel 26 through the openings 42.

Figure 4:
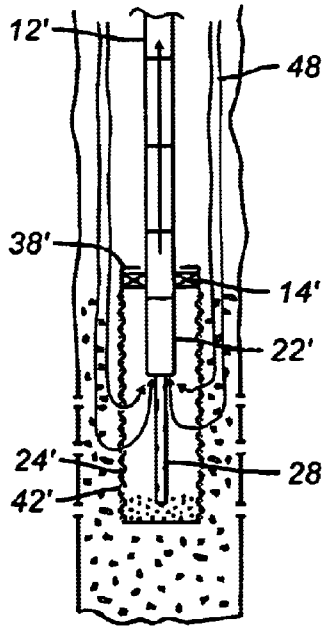
FIG. 4 is an alternate embodiment of the method using reverse flow and no screen isolation.

FIG. 4 illustrates an alternative embodiment. Here the spear 22' acts in conjunction with an isolation seal 14' to seal off the top end 38' of the screen 24'. The perforating guns 28' make openings 42' in screen 24'. Reverse circulation from the surface represented by arrow 48 enters the gravel 26' and forces it through openings 42' in conjunction with vibration from vibration tool 20'. The gravel 26' returns to the surface through tubing 12'. When the screen 24' breaks loose, it is pulled up to the surface by raising string 12', just as in the previously described embodiment. This method could also be used with circulation instead of reverse circulation.

Those skilled in the art will appreciate that by assembling known components described above into a unique bottom hole assembly B, a screen 24 or 24' can be simply dislodged through the use of reverse circulation or circulation with or without simultaneous vibration. Flow can be run before, during, or after vibration. The vibrating device can be powered electrically or hydraulically. The blast from the perforating gun 28 is designed to penetrate the screen 24 but not to do damage to the casing 32. The perforations 32 are subsequently isolated in a known manner after removal of screen 24. The method allows enough gravel to be displaced to loosen screen 24 for removal with a pickup force well within the limits of the tubing 12 and the surface equipment.

The foregoing disclosure and description of the invention are illustrative and explanatory thereof, and various changes in the size, shape and materials, as well as in the details of the illustrated construction, may be made without departing from the spirit of the invention.

I claim:

1. A method of removing a screen from a wellbore after it has been gravel packed, comprising:

running a string having a gripping tool and a hole making tool into the wellbore;

gripping the screen with said gripping tool;

making at least one hole in the screen with said hole making tool;

selectively moving fluid into the wellbore to urge gravel to move away from said screen; and removing said screen with said string.

2. The method of claim 1, comprising:

inserting said hole making tool into the screen.

3. The method of claim 1, comprising:

vibrating the screen alternatively with said selectively moving fluid.

4. The method of claim 1, comprising:

vibrating the screen simultaneously with said selectively moving fluid.

5. The method of claim 2, comprising:

using at least one perforating gun as said hole making tool.

6. The method of claim 1, comprising:

running a pack off tool on said string;

sealing the wellbore above the screen with said pack off tool;

allowing said moving fluid to pass through said seal in said wellbore.

7. The method of claim 6, comprising:

pumping fluid down said string;

providing a reversing valve in said string adjacent said seal in the wellbore;

directing fluid through said seal in the wellbore and out through said reversing valve into contact with the gravel outside the screen.

8. The method of claim 7, comprising:

using fluid to force gravel through said hole and back through said reversing valve to an annulus around said string located above said seal in the wellbore.

9. The method of claim 8, comprising:

vibrating the screen.

10. The method of claim 1, comprising:

moving said fluid downhole in an annular space outside said string;

contacting the gravel with said fluid;

using said fluid to urge the gravel through said hole; and flowing the grave to the surface through said string.

11. The method of claim 10, comprising:

vibrating the screen.

12. A method of removing a screen from a wellbore after it has been gravel packed, comprising:

running a string having a gripping tool and a hole making tool into the wellbore;

gripping the screen with said gripping tool;

making at least one hole in the screen with said hole making tool;

selectively vibrating the screen to urge gravel to move away from said screen; and removing said screen with said string.

13. The method of claim 12, comprising:

inserting said hole making tool into the screen.

14. The method of claim 12, comprising:

selectively moving fluid into the wellbore to urge gravel to move away from said screen.

15. The method of claim 14, comprising:

urging the gravel with said moving fluid to flow through said hole into the screen for ultimate removal from the wellbore.

16. The method of claim 15, comprising:

reverse circulating said moving fluid down an annular space outside said string to reach said gravel.

17. The method of claim 15, comprising:

running a pack off tool on said string;

sealing the wellbore above the screen with said pack off tool;

allowing said moving fluid to pass through said seal in said wellbore.

18. The method of claim 17, comprising:

pumping fluid down said string;

providing a reversing valve in said string adjacent said seal in the wellbore;

directing fluid through said seal in the wellbore and out through said reversing valve into contact with the gravel outside the screen.

19. The method of claim 18, comprising:

using fluid to force gravel through said hole and back through said reversing valve to an annulus around said string located above said seal in the wellbore.

20. The method of claim 19, comprising:

using at least one perforating gun as said hole making tool.

* * * * *

UNITED STATES PATENT AND TRADEMARK OFFICE

CERTIFICATE OF CORRECTION

PATENT NO. : 6,729,407 B2
DATED : May 4, 2004
INVENTOR(S) : Carl W. Stoesz et al.

It is certified that error appears in the above-identified patent and that said Letters Patent is hereby corrected as shown below:

Title page,
Item [75], should read as follows:
-- [75] Inventors: Carl W. Stoesz, Pasadena; David B. Haughton, Houston; James A. Sonnier, Houston; Gerald D. Lynde, Houston; Joesph P. DeGeare, Houston, all of Texas --

Signed and Sealed this

Twenty-second Day of February, 2005

JON W. DUDAS
*Director of the United States Patent and Trademark Office*